United States Patent [19]

Barrier et al.

[11] 4,363,665

[45] Dec. 14, 1982

[54] NOVEL SAND/SILICATE COMPOSITIONS FOR FOUNDRY MOLDS/CORES

[75] Inventors: Gerard Barrier; Jean-Pierre Blanc, both of Antony, France

[73] Assignee: Rhone-Poulenc Industries, Paris, France

[21] Appl. No.: 283,137

[22] Filed: Jul. 14, 1981

[30] Foreign Application Priority Data

Jul. 18, 1980 [FR] France ..... 80 15875

[51] Int. Cl.[3] ..... B28B 7/34

[52] U.S. Cl. ..... 106/38.3; 106/38.35; 106/38.9; 106/84; 164/16; 164/528

[58] Field of Search ..... 106/38.3, 38.35, 38.9, 106/84; 164/16, 528

[56] References Cited

U.S. PATENT DOCUMENTS

| | | | |
|---|---|---|---|
| 3,137,046 | 6/1964 | Barcow et al. | 106/38.35 |
| 3,203,057 | 8/1965 | Alunt et al. | 106/38.3 |
| 4,213,785 | 7/1980 | Blanc et al. | 106/38.35 |
| 4,233,076 | 11/1980 | Blanc et al. | 106/38.35 |

*Primary Examiner*—Lorenzo B. Hayes

*Attorney, Agent, or Firm*—Burns, Doane, Swecker & Mathis

[57] ABSTRACT

Foundry mold and core compositions containing sand, an alkali metal silicate and a hardening agent therefor include, and are characterized by, a demolding agent comprising a finely divided inorganic metal compound, together with from 1 to 99% by weight thereof, of a hydrated alumina having an average grain size ranging from 0.2 to 5μ.

15 Claims, No Drawings

NOVEL SAND/SILICATE COMPOSITIONS FOR FOUNDRY MOLDS/CORES

BACKGROUND OF THE INVENTION

1. Field of the Invention

The present invention relates to novel compositions of matter for foundry molds and cores, and, more especially, to such compositions comprising a silicate based binder.

2. Description of the Prior Art

It has long been known to this art to prepare foundry cores and molds by utilizing a ternary mixture comprising 93 to 98 parts by weight of a sand suitable for foundry purposes, 2 to 7 parts by weight of an aqueous solution of an alkali metal silicate and a stoichiometric amount, relative to the silicate, of an organic carbonate ester. Compare U.S. Pat. No. 3,137,046. Molds having satisfactory mechanical properties are obtained by this method.

Such compositions typically were hardened with carbon dioxide. The process was said to be improved by employing different additives therein, as per French Pat. No. 1,172,636. Finally, an attempt was made to eliminate the use of carbon dioxide gas, especially in the molding of the larger shaped articles, because the gaseous hardening agent displayed certain disadvantages, particularly at elevated temperatures.

Thus, in U.S. Pat. No. 3,203,057, it is proposed to use a binder comprising an aqueous solution of an alkali metal silicate and an additive consisting essentially of 3 to 100% alumina with respect to the binder.

However, it is known that, of these compositions, numerous desirable properties are required. In particular, good mechanical properties are expected of the cores and molds. It is further desired to simultaneously obtain shorter setting times and a relatively extended useful life.

"Useful life" is defined as that period of time during which it is possible to store the mixture of sand, silicate and hardener, without a reduction in mechanical properties, from the moment that the silicate is added to the mixture of sand plus hardener.

"Setting time" is defined as that period of time which intervenes between the moment that the silicate is added to the mixture of sand plus hardener to that point in time when modifications are no longer observed on the surface of the agglomerated sand. In practice, the point of setting is determined simply by exerting pressure on said surface of the sand mix.

The immediately foregoing can be said to characterize those reasons why it was recently proposed, in U.S. Pat. No. 4,213,785, assigned to the assignee hereof, to employ hardening or curing catalysts of aqueous solutions of alkali metal silicates based on alkylene carbonates and additionally containing methyl esters of the organic acids.

But even though such hardeners, used in combination with sand and alkali metal silicate based binders, afford excellent results as regards ultimate mechanical properties, useful lives and setting times, one problem remained without a satisfactory solution, namely, demolding. "Demolding" is defined as that step of extracting or removing with relative ease the sand located within the cavities formed by the cores, from the metal casting.

In effect, the agglomerated sand comprising the various molds and cores must have a high mechanical strength prior to the pouring of the molten metal and must retain a satisfactory mechanical strength at elevated temperatures, but same should have mechanical properties such that the sand may be readily extracted or removed, once the metal has cooled.

To facilitate demolding, it too is known to this art to employ certain carbonaceous materials and/or film-forming resinous adhesives [French Pat. No. 2,237,706], but the phenomenon of recarburization may occur.

And consistent with U.S. Pat. No. 4,233,076, also assigned to the assignee hereof, essential solution to the aforesaid problem is found by utilizing foundry mold and core compositions comprising sand, a binder based upon an alkali metal silicate, and a hardening agent, by including in such compositions a demolding agent which comprises at least in part, an alumina having an average grain size of less than 40μ, and preferably an average grain size of between 0.2 and 5μ.

Such compositions afford excellent results, notably in the case of high temperature treatments, e.g., the casting of iron or steel. Nonetheless, the efficacy of the process declines if the nature of the metal being cast mandates lower operating temperatures, e.g., on the order of 750° C.

Also compare French Pat. Nos. 1,545,740 and 2,014,408.

SUMMARY OF THE INVENTION

Accordingly, a major object of the present invention is the provision of improved foundry compositions suitable for both high and relatively low temperature applications, and which otherwise avoid those problems to date plaguing the state of this art.

Briefly, the subject foundry and core compositions comprise sand, a binder based upon an alkali metal silicate, a hardening agent, and a demolding agent, characterized in that the demolding agent comprises an inorganic metal compound, advantageously an inorganic alkaline earth metal compound, desirably in the form of a fine powder, in combination with a hydrated alumina having an average grain size distribution ranging from 0.2 to 5μ, preferably from 0.5 to 3μ.

DETAILED DESCRIPTION OF THE INVENTION

More particularly according to this invention, it has now unexpectedly been determined that the combination of the alumina with the inorganic metal compound indeed affords synergistic results consistent herewith.

This surprising phenomenon of synergism is facilely demonstrated vis-a-vis the result that both the mechanical properties and the friability of the subject compositions are markedly improved by substituting, for a fraction of a wholly alumina demolding agent, the combination demolding agent according to the invention. Markedly synergistic results are moreover obtained when including a calcium or magnesium oxide, or carbonate, having an average grain size of less than about 5μ, in the topic bipartite demolding agents.

In a preferred embodiment of the invention, the combination demolding agent comprises from 1 to 99% of hydrated alumina having an average grain size ranging from 0.2 to 5μ, preferably from 0.5 to 3μ, and 1 to 99% of the inorganic metal compound.

Further, the alumina incorporated according to the invention advantageously has a B.E.T. surface of less than 300 $m^2/g$, and preferably between 3 and 40 $m^2/g$.

According to an especially advantageous embodiment of the invention, $Al_2O_3.3H_2O$ alumina is incorporated, of hydrargillite type.

In practice and preferentially, the compositions of the invention comprise 90 to 98 parts by weight of sand, 2 to 10 parts by weight of a solution of an alkali metal silicate, 0.5 and 5% by weight of the alumina, preferably from 0.8 to 1.7% by weight of the alumina, and 0.5 to 5 parts by weight of the inorganic metal additive.

The silicate according to the invention preferably has a $SiO_2/Na_2O$ weight ratio comprised between 2 and 2.7.

As the hardener, there may specifically be utilized a compound selected from the group comprising the alkylene carbonates and/or organic esters, such as the mono-, di- and triacetins, and admixtures thereof, the glycol esters, and notably the methyl esters, particularly the methyl esters of organic monoacids, optionally substituted with other functional groups, such as methyl lactate; same may also be dimethyl esters of organic diacids, such as $\alpha,\omega$-aliphatic diacids having from three to ten carbon atoms, such as, for example, malonic acid, succinic acid, glutaric acid and adipic acid.

The cyclic alkylene carbonates envisaged typically are characterized by an alkylene radical preferably having two to six carbon atoms; those carbonates typically employed are ethylene carbonate and propylene carbonate.

In general, 4 to 30 parts by weight of the methyl ester of an organic acid are employed per 96 to 70 parts by weight of the alkylene carbonate; optionally, the mixture may be diluted with a solvent which controls the reactivity with the alkali metal silicate. As such solvents, aliphatic polyols, and preferably the polyalkylene glycols, may be used, for example, diethylene glycol. These solvents may be used, for example, in an amount of 2 to 20 parts by weight per 100 parts by weight of the alkylene carbonate/methyl ester hardener.

It too is within the scope of the present invention to use another and different hardener, such as gaseous carbon dioxide or a blast furnace slag.

The processes employed to obtain or fabricate a mold or a core for foundry use are those conventionally employed in this technology, such as described, for example, in U.S. Pat. No. 3,307,046 or French Pat. No. 2,264,608. In particular, it is possible to operate at ambient temperature, i.e., roughly between 0° and 30° C.

EXAMPLES

In order to further illustrate the present invention and the advantages thereof, the following specific examples are given, it being understood that same are intended only as illustrative and in nowise limitative.

In the examples which follow, the following mode of operation was employed:

Into a Kenwood planetary mixer, the components of the mixture were introduced, at a temperature comprised between 18° and 20° C., and in the following order:

(i) Sifraco sand (reference AFA 53-57);
(ii) the demolding agent;
(iii) the hardening agent; and
(iv) the aqueous solution of the alkali metal silicate.

The sodium silicate solution had a water content of 55% and a dry extract of 45%. The $SiO_2/Na_2O$ weight ratio was equal to 2.39, the density at 20° C. was 1.525 and the viscosity was 600 millipascals per second at 20° C.

The sand utilized had the following properties: specific surface area, 115 $cm^2/g$; apparent density, 1.5; heating loss, 0.15%. It contained a minimum of 99.7% $SiO_2$ and a maximum of 0.1% clay with traces of calcium carbonate. Its grain size distribution was:

1% larger than 420μ;
26% comprised between 420 and 300μ;
47% comprised between 300 and 210μ;
23% comprised between 210 and 150μ; and
3% comprised between 150 and 105μ.

Compression Testing

Compression strength was determined according to the technical standard of Centre technique des Industries de la Fonderie, Division des etudes du moulage sable, July 1971 (Technical Center of the Foundry Industries [TCFI], Division of Sand Molding):

Following formulation of the molding admixture (sand+hardener+silicate+demolding agent) in the Kenwood planetary mixer, seven (7) compression test specimens were prepared over the course of 4 minutes in a core box. The specimens were in accordance with DIN 52-401 (type G.F.) standard, and the compression strengths were measured at time intervals varying from 10 minutes to 1 hour, in a GF apparatus, type SPOR. The reference point for the onset of the timing measurements was the point of introduction of the silicate.

Shear Strength Testing

Shear strength was determined according to the technical standard of TCFI, by preparing specimens in accordance with DIN 52-401 (type G.F.) standard.

Friability Testing

The specimen was heated to the indicated temperature of 500° C., 750° C. and 1000° C. in a furnace, over the course of 30 minutes, and was, after cooling, placed in a tube, with a weight of 600 g being dropped thereupon from a height of 50 cm. The broken pieces were screened on a 2 mm mesh screen for 10 seconds. The ratio by weight of refuse/initial weight is considered representative of friability, F. If F is close to 0, it is considered that the demolding is good, and if F is in the vicinity of 1, demolding characteristics are virtually absent.

It will again be appreciated, as heretofore mentioned, that a good demolding agent must not adversely affect the mechanical properties of the specimen.

EXAMPLE 1

In this example, the hardening agent comprised 80% of an admixture of the methyl esters of adipic, glutaric and succinic acids, and 20% of diethylene glycol.

The alumina was a hydrargillite, $Al_2O_3.3H_2O$, having an average gram size of 1μ, a specific surface of 5 $m^2/g$, and containing 35% water of crystallization.

Also in this example, admixture/formulation of the subject composition was carried out by adding 1.8% of the demolding agent to 1 kg of the sand, malaxating this mixture for 2 minutes, next adding 0.5% of the hardening agent thereto, further malaxating for an additional 2 minutes, and then adding 3.5% of the sodium silicate and malaxating for another 2 minutes.

The various results are reported in the following Table I:

TABLE I

| Demolding agent | Composition | R/Compression strength in Pascal, after 24 hours | Friability after 24 hours, at 1000° C. | 750° C. | 500° C. |
|---|---|---|---|---|---|
| Without demolding agent | | $40 \cdot 10^5$ | 0.98 | 0.99 | 0.95 |
| Alumina | 100% | $52 \cdot 10^5$ | 0.10 | 0.35 | 0.80 |
| Demolding agent #1 | 50% alumina 50% calcium carbonate | $55 \cdot 10^5$ | 0.20 | 0.05 | 0.80 |
| Demolding agent #2 | 50% alumina 50% MgO | $50 \cdot 10^5$ | 0.15 | 0.20 | 0.85 |
| Demolding agent #3 | 50% alumina 50% magnesium carbonate | $45 \cdot 10^5$ | 0.15 | 0.05 | 0.75 |
| Demolding agent #4 | 100% magnesium carbonate | $40 \cdot 10^5$ | 0.45 | 0.05 | 0.30 |

In this example, the compression strength was measured after 24 hours, because setting was not immediate and the measurement became significant only after 24 hours.

EXAMPLE 2

The procedure of Example 1 was repeated, except that the hardening was effected utilizing gaseous $CO_2$ for 10 seconds under a pressure of $2 \times 10^5$ Pa.

Shear strengths are reported in Table II, because setting was immediate and shear strength is more significant than compression strength.

TABLE 2

| Demolding agent | Composition | R/Immediate shear strength, in Pascal | Friability after 24 hours, at 1000° C. | 750° C. | 500° C. |
|---|---|---|---|---|---|
| Without demolding agent | | $3 \cdot 10^5$ | 0.92 | 0.94 | 0.94 |
| Alumina | 100% | $3.8 \cdot 10^5$ | 0.05 | 0.30 | 0.80 |
| Demolding agent #1 | 50% alumina 50% calcium carbonate | $4 \cdot 10^5$ | 0.10 | 0.05 | 0.75 |
| Demolding agent #2 | 50% alumina 50% MgO | $3.8 \cdot 10^5$ | 0.15 | 0.20 | 0.75 |

TABLE 2-continued

| Demolding agent | Composition | R/Immediate shear strength, in Pascal | Friability after 24 hours, at 1000° C. | 750° C. | 500° C. |
|---|---|---|---|---|---|
| Demolding agent #3 | 50% alumina 50% magnesium carbonate | $3.4 \cdot 10^5$ | 0.10 | 0.05 | 0.35 |
| Demolding agent #4 | 100% magnesium carbonate | $2.2 \cdot 10^5$ | 0.15 | 0.05 | 0.25 |

It will be seen from the foregoing examples that the partial substitution of the inorganic metal compound for a fraction of the alumina significantly improves friability, while maintaining the mechanical properties at least equal. It too will be seen that if alumina alone is used, demolding at about 750° C. is not entirely satisfactory. Furthermore, when the inorganic metal compound is used alone, the mechanical properties suffer.

Nonetheless, the "combination" according to the invention avoids all of the aforenoted disadvantages and drawbacks.

EXAMPLE 3

The procedure of Example 1 was repeated, except that the hardener was a 40/60 admixture of dimethyl malonate and diethyl malonate, and the demolding agent was a 50/50 admixture of alumina and calcium carbonate.

A friability value of 0.07 was measured at 750° C.

EXAMPLE 4

The procedures of Example 3 was repeated, except that the hardening agent was an 85/15 admixture of diacetin and triacetin.

A friability value of 0.05 was measured at 750° C.

EXAMPLE 5

In this comparative example, magnesium carbonate alone was used per Example 2, as was a 50/50 admixture of alumina and magnesium carbonaie, also per Example 2. Compression and shear strengths were measured on specimens at increasing times after the preparation of a subject composition to determine the useful life thereof.

The results are reported in the Table III which follows:

TABLE III

| Demolding agent | Composition | Time of preparation | R/Compression strength, in Pascal | R/Shear strength, in Pascal | Useful Life |
|---|---|---|---|---|---|
| Demolding agent #3 | 50% alumina | 2 minutes | $19 \cdot 10^5$ | $3.0 \cdot 10^5$ | |
| | | 30 minutes | $14.5 \cdot 10^5$ | $2.6 \cdot 10^5$ | |
| | 50% carbonate | 1 hour | $14.5 \cdot 10^5$ | $2.0 \cdot 10^5$ | |
| | | 1 hour, 30 minutes | $10 \cdot 10^5$ | $2.3 \cdot 10^5$ | 1 hour, 30 minutes |
| | | 2 hours | $5 \cdot 10^5$ | $1.8 \cdot 10^5$ | |
| | | 2 hours, 30 minutes | $3 \cdot 10^5$ | $1.3 \cdot 10^5$ | |
| | | 3 hours | $1 \cdot 10^5$ | $0.8 \cdot 10^5$ | |
| Demolding agent #4 | 100% magnesium carbonate | 2 minutes | $12 \cdot 10^5$ | $2.0 \cdot 10^5$ | |
| | | 30 minutes | $8 \cdot 10^5$ | $1.7 \cdot 10^5$ | |
| | | 1 hour | $6 \cdot 10^5$ | $1.1 \cdot 10^5$ | |
| | | 1 hour, 30 minutes | $3 \cdot 10^5$ | $0.9 \cdot 10^5$ | 5 minutes |
| | | 2 hours | $1 \cdot 10^5$ | $0.5 \cdot 10^5$ | |
| | | 2 hours, 30 minutes | 0 | $0 \cdot 10^5$ | |

TABLE III-continued

| Demolding agent | Composition | Time of preparation | R/Compression strength, in Pascal | R/Shear strength, in Pascal | Useful Life |
|---|---|---|---|---|---|
| | | 3 hours | 0 | $0 \cdot 10^5$ | |

Thus, it is apparent that the demolding admixture according to this invention provides for longer useful lives than the inorganic metal compounds alone, which compounds have far too short useful lives to be of value on an industrial scale.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. In a moldable composition of matter comprising an intimate admixture of sand, an alkali metal silicate, a hardening agent and a demolding agent; the improvement which comprises a demolding agent including a mixture of a finely divided alkaline earth metal oxide or carbonate and from 1 to 99% by weight thereof of a hydrated alumina having an average grain size ranging from 0.2 to 5μ.

2. The composition of matter as defined by claim 1, comprising an oxide or carbonate of calcium or magnesium.

3. The composition of matter as defined by claims 1 or 2, said hydrated alumina comprising $Al_2O_3.3H_2O$.

4. The composition of matter as defined by claim 3, said hydrated alumina having an average grain size ranging from 0.5 to 3μ.

5. The composition of matter as defined by claims 1 or 2, said hydrated alumina having a B.E.T. surface of less than 300 $m^2/g$.

6. The composition of matter as defined by claim 5, said hydrated alumina having a B.E.T. surface ranging from 3 to 40 $m^2/g$.

7. The composition of matter as defined by claim 1 or 2, comprising from 90 to 98 parts by weight of sand, 2 to 10 parts by weight of an alkali metal silicate, 0.5 to 5% by weight of the hydrated alumina, and 0.5 to 5% by weight of the oxide or carbonate.

8. The composition of matter as defined by claim 7, said alkali metal silicate comprising a sodium silicate having a $SiO_2/Na_2O$ ratio by weight ranging from 2 to 2.7.

9. The composition of matter as defined by claim 8, said hardening agent comprising an alkylene carbonate, a carboxylic acid ester or mixture thereof.

10. The composition of matter as defined by claim 9, said hardening agent comprising a methyl ester of a carboxylic acid.

11. The composition of matter as defined by claim 9, said hardening agent comprising from 4 to 30 parts by weight of a methyl ester of a carboxylic acid and 96 to 70 parts by weight of an alkylene carbonate.

12. The composition of matter as defined by claim 8, said hardening agent comprising gaseous carbon dioxide.

13. The composition of matter as defined by claim 8, said hardening agent comprising blast furnace slag.

14. A shaped article comprising the composition of matter as defined by claims 1 or 2.

15. A foundry mold comprising the composition of matter as defined by claims 1 or 2, in cured state.

* * * * *